US010065070B2

(12) United States Patent
Huang

(10) Patent No.: US 10,065,070 B2
(45) Date of Patent: Sep. 4, 2018

(54) FOLDABLE TREADMILL

(71) Applicant: Rexon Industrial Corp., Ltd., Taichung (TW)

(72) Inventor: Chiung-Tung Huang, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 120 days.

(21) Appl. No.: 15/353,779

(22) Filed: Nov. 17, 2016

(65) Prior Publication Data

US 2017/0136288 A1 May 18, 2017

(30) Foreign Application Priority Data

Nov. 18, 2015 (TW) ..... 104138002

(51) Int. Cl.
*A63B 22/02* (2006.01)
*A63B 22/00* (2006.01)

(52) U.S. Cl.
CPC ..... *A63B 22/02* (2013.01); *A63B 22/0015* (2013.01); *A63B 22/0023* (2013.01); *A63B 2210/50* (2013.01); *A63B 2210/56* (2013.01)

(58) Field of Classification Search
CPC ..... A63B 2210/50; A63B 2210/56
See application file for complete search history.

(56) References Cited

U.S. PATENT DOCUMENTS 5,746,682 A * 5/1998 Hung ..... A63B 22/02 482/51
6,015,368 A * 1/2000 Clem ..... A63B 22/0023 482/54
6,261,209 B1 * 7/2001 Coody ..... A63B 22/0023 482/51
6,592,496 B1 * 7/2003 Tsou ..... A63B 22/0023 482/54
6,638,200 B2 * 10/2003 Chang ..... A63B 22/0023 482/54
6,758,791 B1 * 7/2004 Kuo ..... A63B 22/0023 482/54
6,811,518 B2 * 11/2004 Lin ..... A63B 22/02 482/51
6,857,991 B2 * 2/2005 Yu ..... A63B 22/02 482/54
6,872,169 B2 * 3/2005 Kuo ..... A63B 22/0023 482/51

(Continued)

*Primary Examiner* — Joshua Lee
(74) *Attorney, Agent, or Firm* — Bacon & Thomas, PLLC

(57) ABSTRACT

A foldable treadmill includes a treadbase having two short sides and two long sides, a base frame extended in the extending direction of the short sides of the treadbase and supported on a supporting surface, a linkage unit coupled between the treadbase and the base frame, and a retractable unit including a pivot-connection portion pivotally connected to the base frame and a retractable member interlocking with the linkage unit and movable relative to the pivot-connection portion between a retracted position where the long sides of the treadbase are disposed in proximity to the supporting surface and an extended position where the long sides of said treadbase are disposed far from the supporting surface and the position of the linkage unit is shifted with the retractable member to reduce the clearance between the linkage unit and the treadbase to minimize space occupation.

9 Claims, 7 Drawing Sheets

(56) References Cited

U.S. PATENT DOCUMENTS 6,913,562 B2 * 7/2005 Chen ..... A63B 22/02 482/54
6,916,277 B2 * 7/2005 Chen ..... A63B 22/02 482/54
6,974,404 B1 * 12/2005 Watterson ..... A63B 22/0023 482/51
6,984,193 B2 * 1/2006 Chen ..... A63B 22/0023 482/54
7,097,594 B2 * 8/2006 Lo ..... A63B 22/0235 482/54
7,211,029 B2 * 5/2007 Kau ..... A63B 22/02 482/54
7,357,758 B2 * 4/2008 Polk, III ..... A63B 22/0023 482/54
7,381,160 B2 * 6/2008 Lo ..... A63B 22/02 482/51
7,736,280 B2 * 6/2010 Weier ..... A63B 22/02 482/51
7,789,807 B1 * 9/2010 Wang ..... A63B 22/0235 482/52
7,883,448 B2 * 2/2011 Wang ..... A63B 22/0235 482/54
8,734,303 B2 * 5/2014 Huang ..... A63B 22/02 482/54
9,039,578 B2 * 5/2015 Dalebout ..... A63B 22/0002 482/54
9,044,638 B2 * 6/2015 Huang ..... A63B 22/0235
9,138,615 B2 * 9/2015 Olson ..... A63B 22/02
9,707,441 B2 * 7/2017 Yang ..... A63B 22/02
2001/0049323 A1 * 12/2001 Fox ..... A63B 22/0023 482/54
2002/0147078 A1 * 10/2002 Wu ..... A63B 22/0023 482/54
2003/0236153 A1 * 12/2003 Pan ..... A63B 22/0023 482/54
2004/0023758 A1 * 2/2004 Chang ..... A63B 22/02 482/54
2005/0164840 A1 * 7/2005 Chen ..... A63B 22/02 482/54
2006/0003869 A1 * 1/2006 Huang ..... A63B 22/02 482/54
2006/0240951 A1 * 10/2006 Wang ..... A63B 22/02 482/54
2007/0004561 A1 * 1/2007 Yoo ..... A63B 22/0023 482/54
2007/0191190 A1 * 8/2007 Kuo ..... A63B 22/0023 482/54
2008/0004162 A1 * 1/2008 Chen ..... A63B 22/02 482/54
2008/0070756 A1 * 3/2008 Chu ..... A63B 22/02 482/54
2008/0188358 A1 * 8/2008 Kuo ..... A63B 22/02 482/54
2008/0312046 A1 * 12/2008 Lin ..... A63B 22/02 482/54
2009/0124466 A1 * 5/2009 Zhang ..... A63B 22/02 482/54
2009/0181831 A1 * 7/2009 Kuo ..... A63B 22/0023 482/54
2010/0056344 A1 * 3/2010 Chu ..... A63B 22/02 482/54
2012/0071299 A1 * 3/2012 Yang ..... A63B 22/02 482/54
2012/0165162 A1 * 6/2012 Lu ..... A63B 22/0235 482/54
2013/0267386 A1 * 10/2013 Her ..... A63B 22/02 482/54
2014/0221167 A1 * 8/2014 Wu ..... A63B 22/0023 482/54

* cited by examiner

FOLDABLE TREADMILL

BACKGROUND OF THE INVENTION

1. Field of the Invention

The present invention relates to treadmill technology and more particularly, to a foldable treadmill.

2. Description of the Related Art

FIG. 1 illustrates a treadmill 1 according to Taiwan Patent M316743. According to this design, the treadmill 1 comprises a rectangular base frame 11, a treadbase 12 pivotally connected to the base frame 11, and two retractable cylinders 13. The base frame 11 comprises two opposing side bars 111, and two opposing end bars 112 connected between the two side bars 111 at two opposite sides. The treadbase 12 is biasable relative to the base frame 11 between a vertically extended collapsed position and a horizontally extended operating position. The retractable cylinders 13 are connected between the side bars 111 of the base frame 11 and the treadbase 12 and retractable relative to the base frame 11. When the treadbase 12 is set in the illustrated collapsed position, the cylinders 13 impart a pressure to the treadbase 12, holding the treadbase 12 in position.

In order not to interfere with the biasing of the treadbase 12 and to let the retractable cylinders 13 extend smoothly to an outward position, it is normal to mount the retractable cylinders 13 at the side bars 111 or at one of the end bars 112 of the base frame 11. However, in order to enable the retractable cylinders 13 to be mounted at the side bars 111 of the base frame 11, the size of the base frame 11 cannot be minimized For allowing the retractable cylinders 13 to be mounted at one end bar 112 of the base frame 11, the base frame 11 must be provided with another end bar 112 for the connection of the treadbase 12, and thus, the size of the base frame 11 cannot be minimized Therefore, the aforesaid prior art design occupies too large of an installation space.

SUMMARY OF THE INVENTION

The present invention has been developed in view of the aforementioned circumstances. It is one of the main objects of the present invention to provide a foldable treadmill, which has a significantly reduced occupation space when not in use to greatly improve space efficiency.

To achieve this and other objects of the present invention, a foldable treadmill comprises a treadbase, a base frame, a linkage unit, and a retractable unit. The treadbase comprises two opposing short sides and two opposing long sides. The base frame is supported on a supporting surface and extended in the direction of the shorts sides of the treadbase, and pivotally connected to the treadbase. The linkage unit is pivotally connected between the treadbase and the base frame, defining with the treadbase a clearance therebetween. The retractable unit comprises a pivot-connection portion pivotally connected to the base frame, and a retractable member pivotally connected to the transverse section of the second link and movable relative to the pivot-connection portion between a retracted position where the long sides of the treadbase are disposed in proximity to the supporting surface, and an extended position where the long sides of the treadbase are disposed far from the supporting surface and the position of the linkage unit is shifted with the retractable member to reduce the clearance.

The invention uses the linkage unit to control the clearance between the second link and the treadbase, enabling the retractable unit to interlock between the base frame and the treadbase without affecting its retracting function so that the transverse bar-like base frame can be used to substitute a conventional open frame design, which significantly reduces the occupation space, apparatus cost, and greatly improves space efficiency.

Other and further advantages and features of the present invention will be understood by reference to the following specification in conjunction with the accompanying drawings.

DETAILED DESCRIPTION OF THE INVENTION

Figure 1:
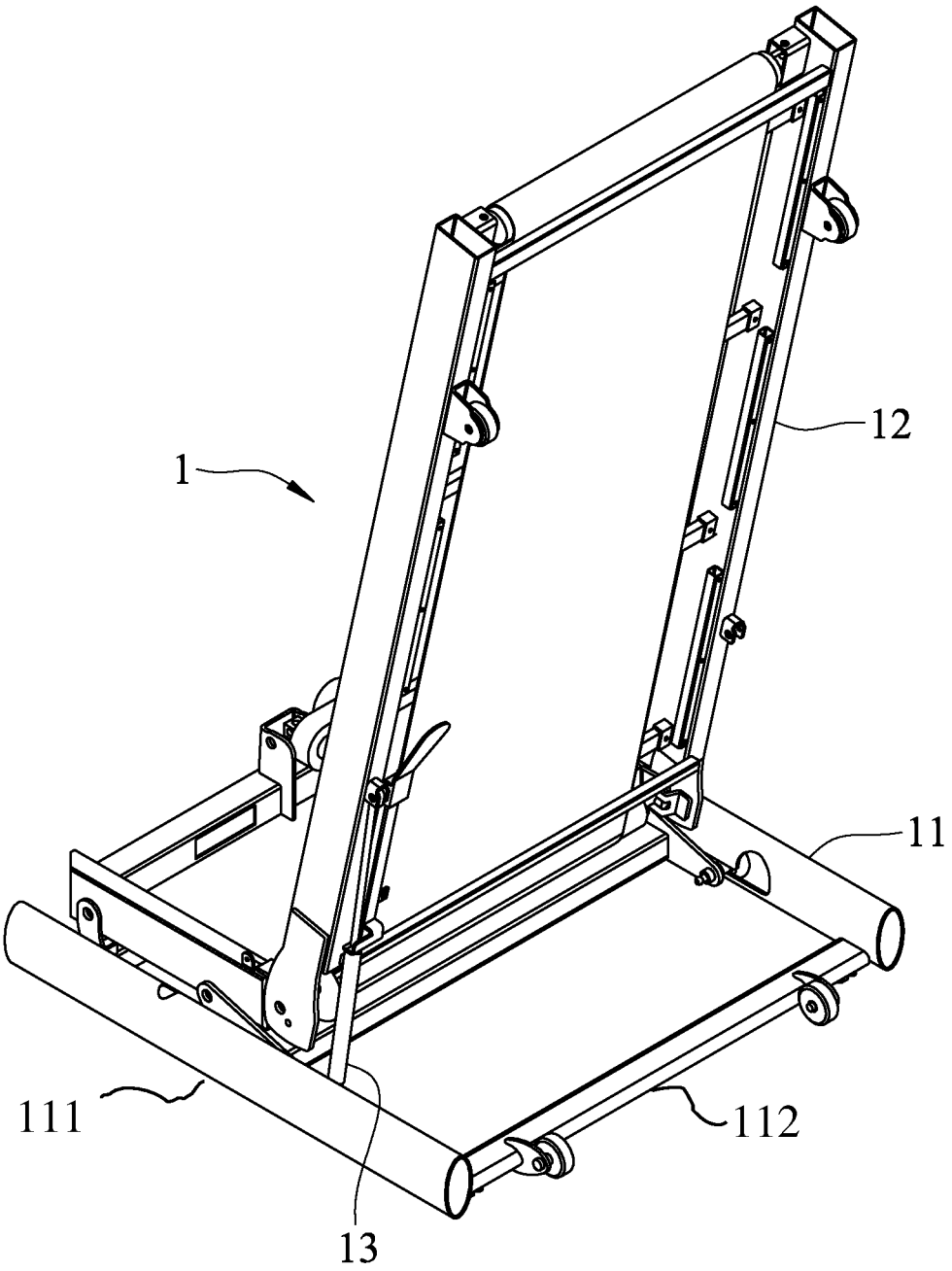
FIG.1 (PRIOR ART)
FIG. 1 is an oblique top elevational view of a foldable treadmill according to Taiwan Patent M316743.
Figure 2:
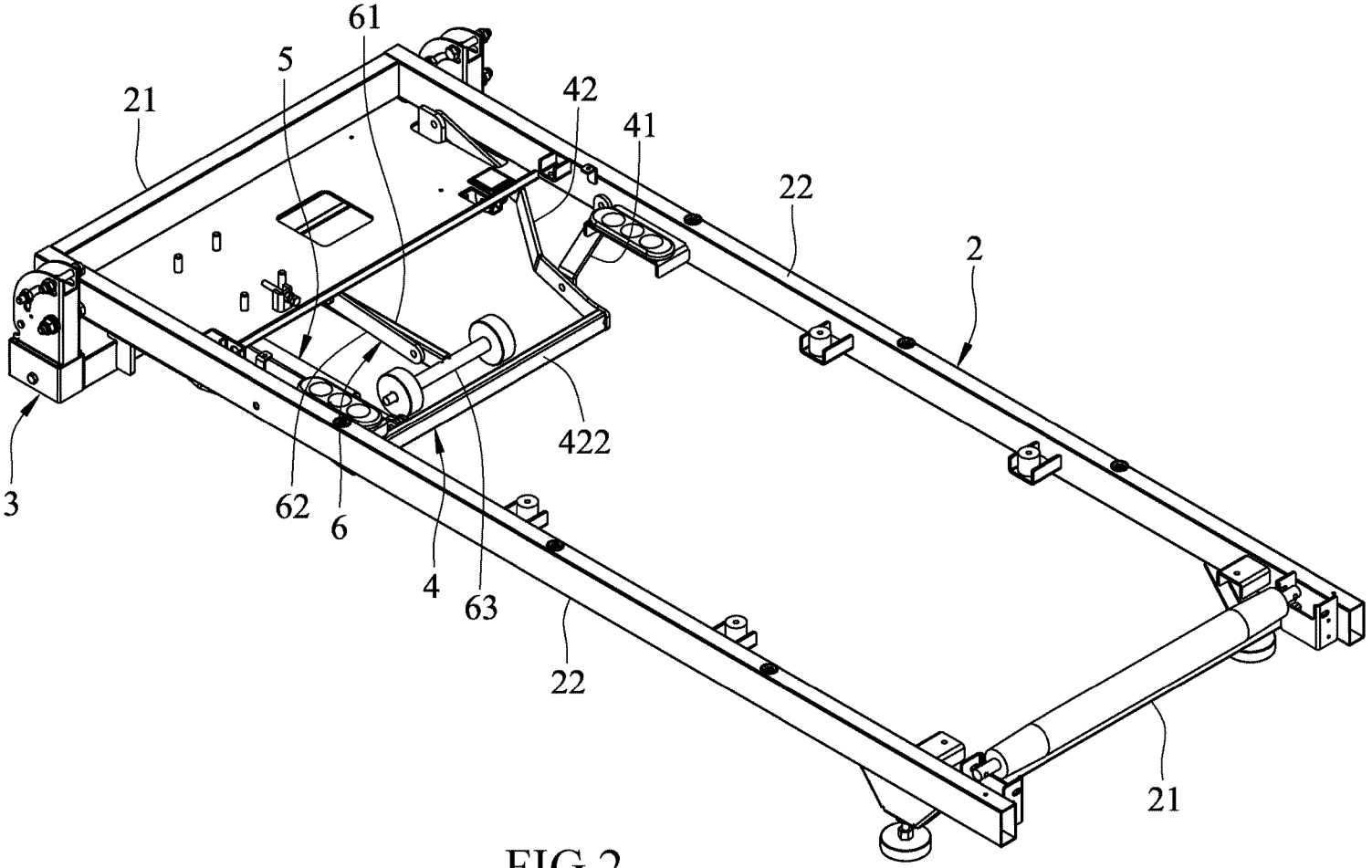
FIG. 2 is an oblique top elevational view of a foldable treadmill in accordance with the present invention.
Figure 3:
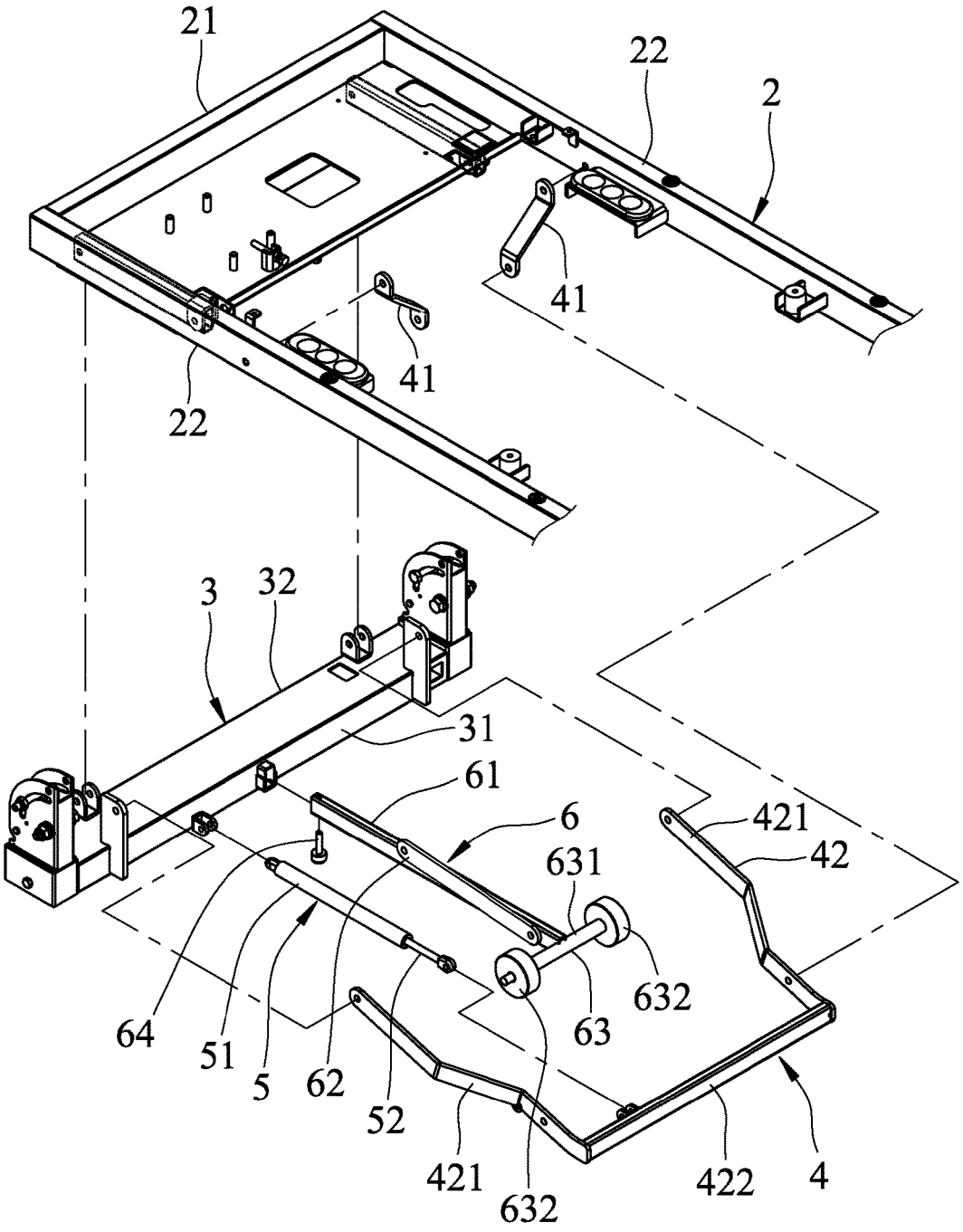
FIG. 3 is an exploded view of the foldable treadmill in accordance with the present invention.
Figure 4:
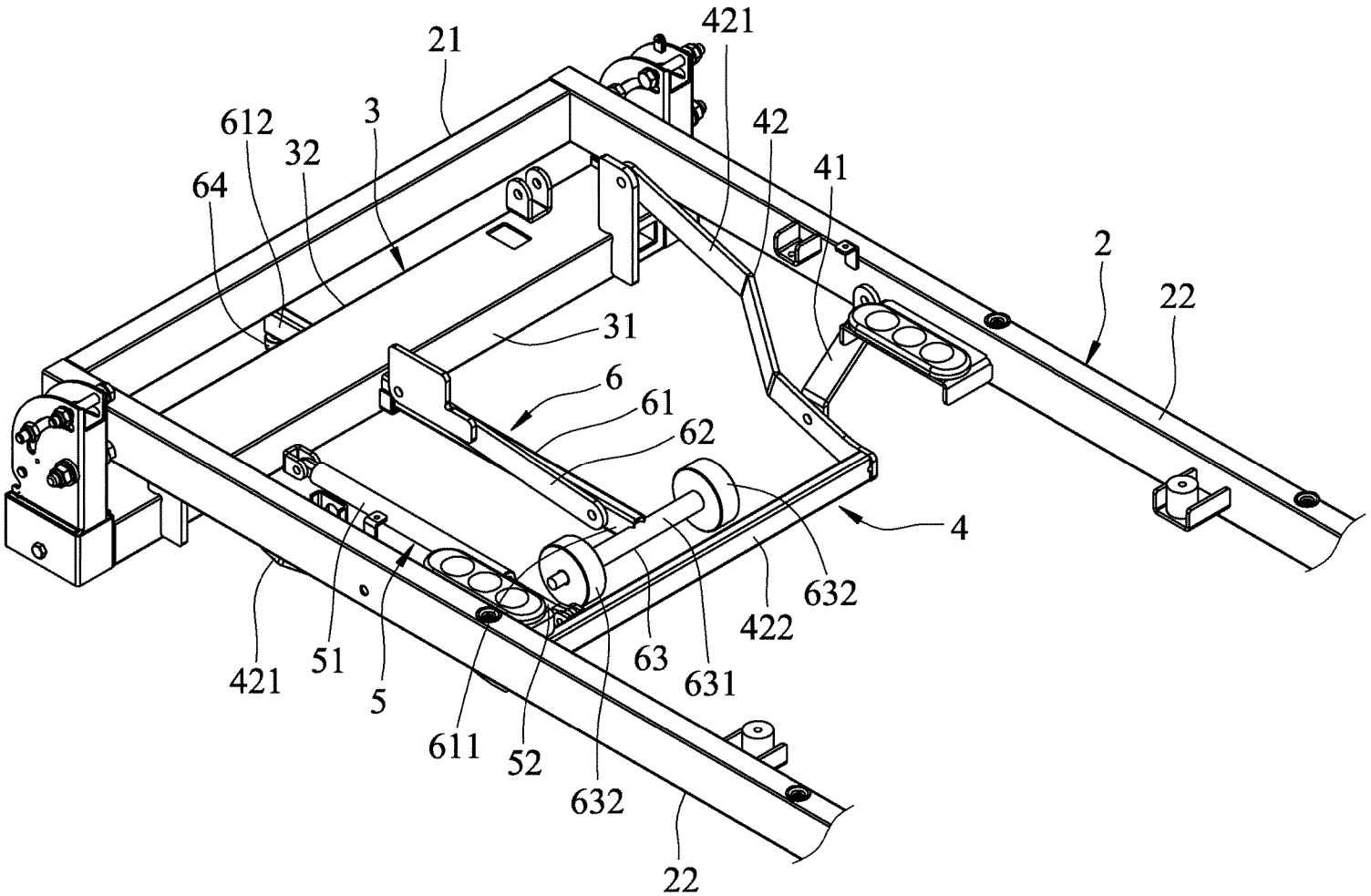
FIG. 4 is an oblique top elevational view of a part of the present invention, illustrating the retractable unit in the retracted position.

Referring to FIGS. 2, 3 and 4, a foldable treadmill in accordance with the present invention is shown. The foldable treadmill comprises a treadbase 2, a base frame 3, a linkage unit 4, a retractable unit 5, and a support unit 6.

The treadbase 2 defines two opposing short sides 21 and two opposing long sides 22.

The base frame 3 is supported on a supporting surface 7 and extends along the short sides 21 of the treadbase 2. Further, the base frame 3 is pivotally connected with the treadbase 2, and comprises two opposing lateral sides 31; 32. Further, the ratio between the length L1 of the base frame 3 in the direction of the long sides 22 of the treadbase 2 and the length L2 of the long sides 22 of the treadbase 2 is 1:20~24.

The linkage unit 4 is pivotally coupled between the treadbase 2 and the base frame 3, comprising two first links 41 and a second link 42 pivotally coupled together. Each first link 41 is pivotally connected to one respective long side 22 of the treadbase 2. The second link 42 in the present preferred embodiment is a ∩-shaped bar pivotally connected to the base frame 3, comprising two lateral sections 421 pivotally connected to the base frame 3 and the respective first links 41 and a transverse section 422 connected between respective one ends of the lateral sections 421 remote from the base frame 3 and spaced from the long sides 22 of the treadbase 2 at a predetermined clearance D.

The retractable unit 5 in the present preferred embodiment can be an air cylinder or hydraulic cylinder, and comprises a pivot-connection portion 51 pivotally connected to the lateral side 31 of the base frame 3 and a retractable member 52 pivotally connected to the transverse section 422 of the second link 42. The retractable member 52 is movable relative to the pivot-connection portion 51 between a retracted position (see FIG. 4 and FIG. 5) and an extended position (see FIG. 6 and FIG. 7).

The support unit 6 comprises a support bar 61 inserted through the lateral sides 31; 32 of the base frame 3, e.g., a passageway through the base frame 3, and movable relative to the base frame 3 in the extending direction of the long sides 22 of the treadbase 2, e.g., in a sliding or rolling manner through the passageway, a connecting bar 62 pivotally connected between the treadbase 2 and a first supporting section 611 of the support bar 61, a roller set 63 mounted at the support bar 61 and movable on the supporting surface 7, and a raiser block 64 mounted at an opposing second supporting section 612 of the support bar 61 to support the treadmill on the supporting surface 7 (where a roller, wheel, footing, or any other equivalent component can be used to substitute for the raiser block 64). The support bar 61 is interlocking with the treadbase 2 through the connecting bar 62, and comprises a part defining the aforesaid first supporting section 611 that extends out of the lateral side 31 of the base frame 3 and is disposed with the retractable unit 5 at the same side relative to the base frame 3, and a second part defining the aforesaid second supporting section 612 that extends out of the lateral side 32 of the base frame 3 and is disposed at an opposite side relative to the base frame 3. The roller set 63 comprises a roller axle 631 mounted at the first supporting section 611 of the support bar 61, and two rollers 632 respectively and pivotally mounted at two opposite ends of the roller axle 631.

Figure 5:
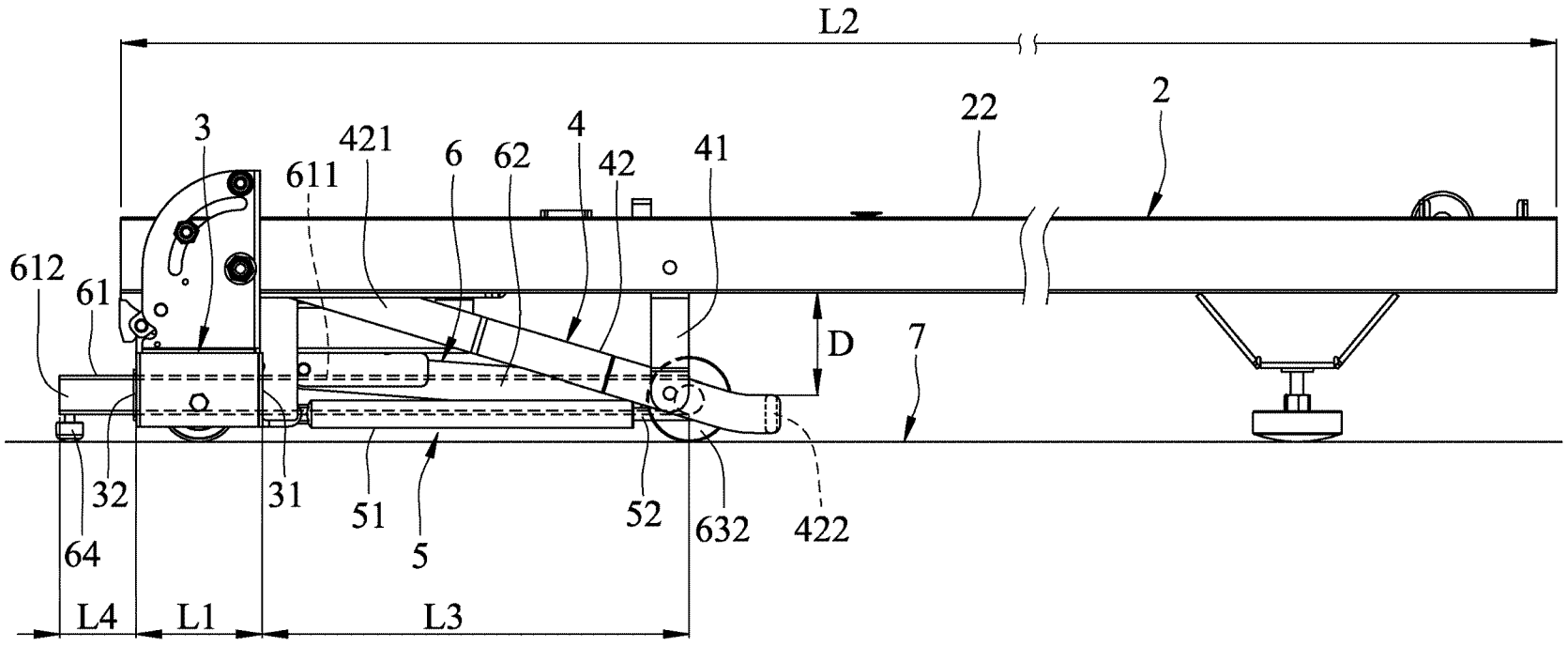
FIG. 5 is a side view of the present invention, illustrating the retractable unit in the retracted position.

Referring to FIG. 5 and FIG. 4 again, when the retractable member 52 is moved to the retracted position, the long sides 22 of the treadbase 2 are disposed in proximity to the supporting surface 7, e.g., parallel to the supporting surface 7 in a horizontally extended operating position, and supported thereon. At this time, the exposed length of the retractable member 52 of the retractable unit 5 is relatively shorter, and thus, the transverse section 422 of the second link 42 of the linkage unit 4 is dragged or moved by the retractable member 52 to a changed position, by expanding or increasing the clearance D between the second link 42 and the treadbase 2.

At the same time, the support bar 61 is moved with the long sides 22 of the treadbase 2 to approach to the supporting surface 7, forcing the connecting bar 62 to move the support bar 61 toward the transverse section 422 of the second link 42 so that the exposed length L3 of the first supporting section 611 becomes longer than the exposed length L4 of the second supporting section 612, e.g., by the sliding of the supporting shaft 61 through the base frame 3. Since a longer part of the first supporting section 611 is extended out of the lateral side 31 of the base frame 3 and disposed with the treadbase 2 at the same side relative to the base frame 3, the relatively longer first supporting section 611 and the relatively shorter second supporting section 612 of the support bar 61 are used to balance and support the treadbase 2.

Figure 6:
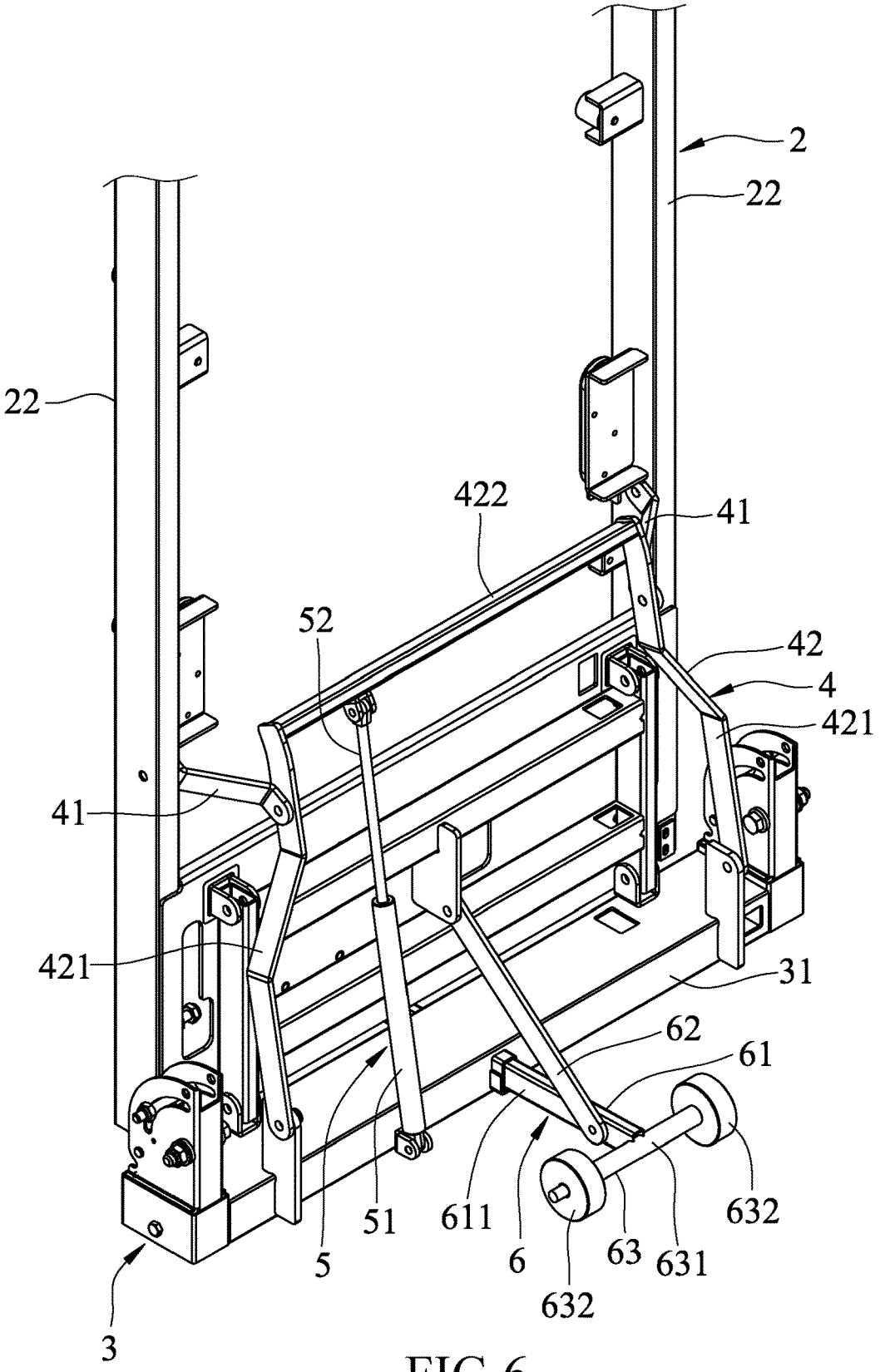
FIG. 6 is an oblique top elevational view of a part of the present invention, illustrating the retractable unit in the extended position.
Figure 7:
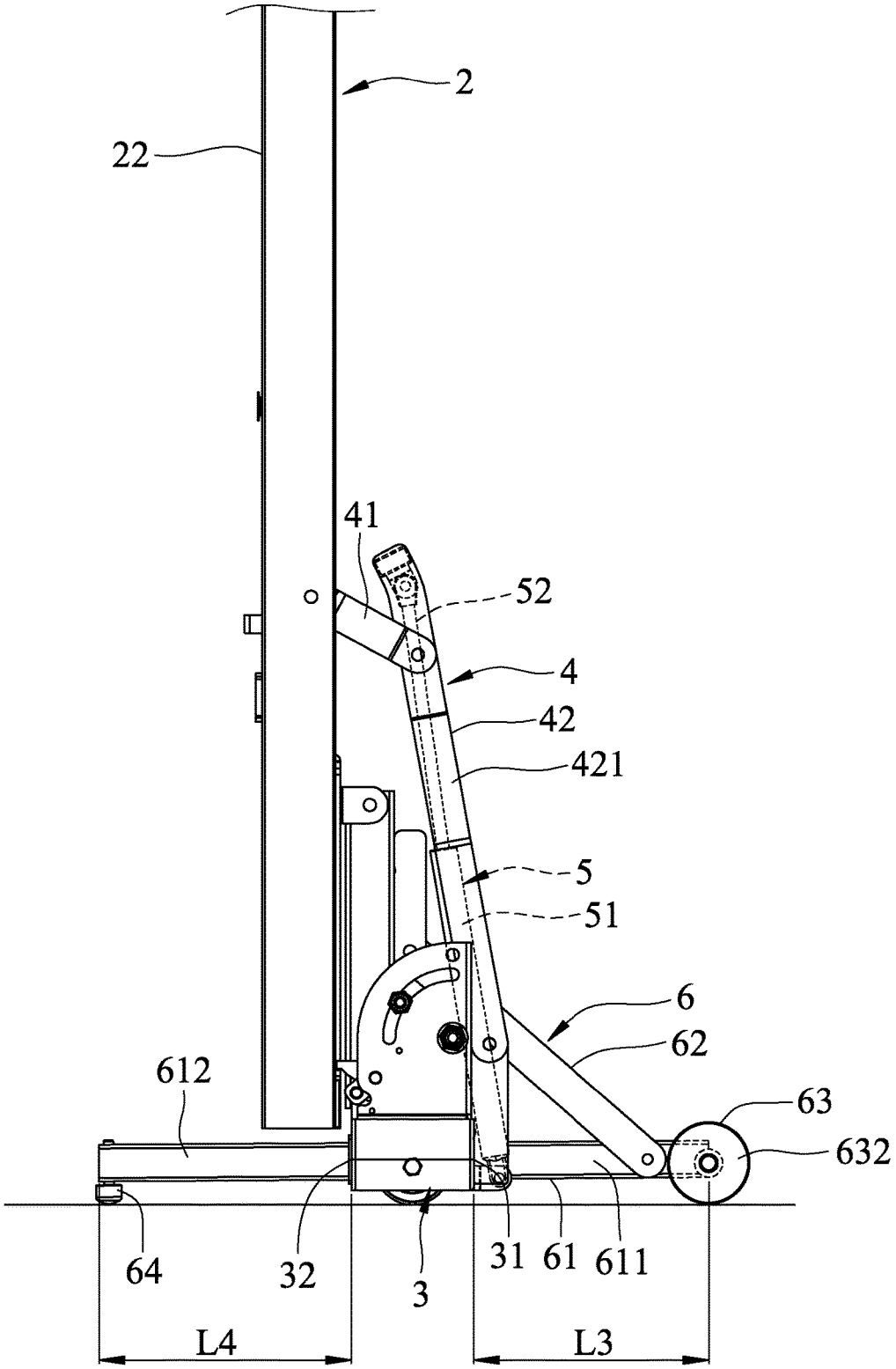
FIG. 7 is a side view of the present invention, illustrating the retractable unit in the extended position.

Referring to FIG. 6 and FIG. 7, when the retractable member 52 is moved to the extended position, the long sides 22 of the treadbase 2 are kept far from the supporting surface 7, e.g., perpendicular to the supporting surface 7 in a vertically extended collapsed position, and supported on the base frame 3. At this time, the exposed length of the retractable member 52 of the retractable unit 5 is relatively longer from the pivot-connection portion 51, and thus, the transverse section 422 of the second link 42 of the linkage unit 4 is pushed by the retractable member 52 to reduce the clearance D between the second link 42 and the treadbase 2.

At the same time, the support bar 61 is moved with the long sides 22 of the treadbase 2, which are moved in a direction away from the supporting surface 7, e.g., perpendicular, forcing the connecting bar 62 to move the support bar 61 in a direction away from the transverse section 422 of the second link 42 so that the exposed length L4 of the second supporting section 612 becomes greater, e.g., longer, relatively, than the exposed length L3 of the first supporting section 611 by the sliding of the supporting shaft through the base frame 3. At this time, the treadbase 2 is erected on the base frame 3 with the center of gravity shifted toward the lateral side 32 of the base frame 3, however, because a longer part of the second supporting section 612 is extended out of the lateral side 32 of the base frame 3, e.g., part of the first supporting section 611 is moved to the lateral side 32, the relatively shorter first supporting section 611 and the relatively longer second supporting section 612 of the support bar 61 can support and balance the treadbase 2 positively.

From the above description, it is clear that the preferred embodiment of the present invention has the advantages as follows:

The invention uses the linkage unit 4 to control or change the clearance D distance between the second link 42 and the treadbase 2, enabling the retractable unit 5 to interlock between the base frame 3 and the treadbase 2 without affecting its retracting function so that the transverse bar-like base frame 3 can be used to substitute for the conventional open frame design, which significantly reduces the occupation of space occupation, apparatus cost, and greatly improves space efficiency.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A foldable treadmill, comprising:

a treadbase comprising two opposing short sides and two opposing long sides;

a base frame supportable on a supporting surface and extended in a direction of said short sides of said treadbase and pivotally connected to said treadbase;

a linkage unit pivotally connected between said treadbase and said base frame and defining with said treadbase a clearance therebetween, said linkage unit comprising a second link having a transverse section, wherein said linkage unit further comprises two first links pivotally coupled with said second link, each said first link being pivotally connected to one respective said long side of said treadbase, said second link being pivotally connected to said base frame; and a retractable unit comprising a pivot-connection portion pivotally connected to said base frame and a retractable member pivotally connected to said transverse section of said second link and movable relative to said pivot-connection portion between a retracted position when said long sides of said treadbase are disposed in proximity to said supporting surface and an extended position when said long sides of said treadbase are disposed away from said supporting surface and a position of said linkage unit is shifted with said retractable member to reduce said clearance.

2. The foldable treadmill as claimed in claim 1, wherein a ratio between the length of said base frame in a direction of said long sides of said treadbase and the length of said long sides of said treadbase is in the range of 1:20 to 1:24.

3. The foldable treadmill as claimed in claim 1, further comprising two lateral sections pivotally connected to said base frame and the respective said first links, and said transverse section is connected between respective one ends of said lateral sections remote from said base frame.

4. The foldable treadmill as claimed in claim 1, wherein said retractable unit is an air cylinder or a hydraulic cylinder.

5. The foldable treadmill as claimed in claim 1, further comprising a support unit, said support unit comprising a support bar inserted through said base frame and movable relative to said base frame in the extending direction of said long sides of said treadbase and interlocked with said treadbase, said support bar comprising a first supporting section extended out of one lateral side of said base frame and disposed with said retractable unit at a same side relative to said base frame and an opposing second supporting section extended out of an opposite lateral side of said base frame, a length of said first supporting section of said support bar being larger than a length of said second supporting section when said retractable member of said retractable unit is in said retracted position, and the length of said second supporting section of said support bar being larger than the length of said first supporting section when said retractable member of said retractable unit is in said extended position.

6. The foldable treadmill as claimed in claim 5, wherein said support unit further comprises a connecting bar pivotally connected between said treadbase and said first supporting section of said support bar for allowing interlocking between said treadbase and said support bar.

7. The foldable treadmill as claimed in claim 5, wherein said support unit further comprises a roller set mounted at said support bar.

8. The foldable treadmill as claimed in claim 6, wherein said roller set comprises a roller axle pivotally mounted at said first supporting section of said support bar, and two rollers respectively pivotally mounted at two opposite ends of said roller axle.

9. The foldable treadmill as claimed in claim 5, wherein said support unit further comprises a raiser block mounted at said second supporting section of said support bar.

* * * * *